US009728900B1

(12) United States Patent
Tsai et al.

(10) Patent No.: US 9,728,900 B1
(45) Date of Patent: Aug. 8, 2017

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Hsien-Lung Huang, New Taipei (TW); Hsu-Fen Wang, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 15/415,160

(22) Filed: Jan. 25, 2017

Related U.S. Application Data

(60) Provisional application No. 62/291,137, filed on Feb. 4, 2016.

(51) Int. Cl.

| | |
|---|---|
| ***H01R 9/03*** | (2006.01) |
| ***H01R 13/52*** | (2006.01) |
| ***H01R 13/6581*** | (2011.01) |
| ***H01R 24/60*** | (2011.01) |
| *H01R 107/00* | (2006.01) |

(52) U.S. Cl.
CPC ..... *H01R 13/6581* (2013.01); *H01R 13/5219* (2013.01); *H01R 24/60* (2013.01); *H01R 2107/00* (2013.01)

(58) Field of Classification Search
CPC H01R 24/60; H01R 13/5219; H01R 13/6581; H01R 2107/00
USPC ..... 439/607.57, 607.58
See application file for complete search history.

(56) References Cited

U.S. PATENT DOCUMENTS

| | | | | |
|---|---|---|---|---|
| 8,083,549 | B1 * | 12/2011 | Chiang | H01R 13/6581 439/607.55 |
| 8,662,928 | B1 * | 3/2014 | Xie | H01R 12/724 439/607.35 |
| 9,385,499 | B2 * | 7/2016 | Guo | H01R 43/24 |
| 9,437,957 | B2 * | 9/2016 | Lee | H01R 13/5202 |

* cited by examiner

*Primary Examiner* — Briggitte R Hammond
(74) *Attorney, Agent, or Firm* — Muncy, Geissler, Olds & Lowe, P.C.

(57) ABSTRACT

An electrical receptacle connector includes a terminal module, an inner metallic shell, an outer insulation frame, and an outer metallic shell. The terminal module is assembled with the inner metallic shell and the outer insulation frame, the outer metallic shell is formed on the outer insulation frame, and the outer metallic shell is in contact with the inner metallic shell. The connector is provided with the outer insulation frame so as to prevent water moist entering into the other end of the outer insulation frame from one end of the outer insulation frame having the insertion opening. In addition, the outer metallic shell is formed on the outer insulation frame to improve the structural strength of the connector. Moreover, the outer metallic shell and the inner metallic shell are soldered with each other through the grooves of the outer insulation frame.

14 Claims, 8 Drawing Sheets

ELECTRICAL RECEPTACLE CONNECTOR

CROSS-REFERENCE TO RELATED APPLICATION

This non-provisional application claims priority under 35 U.S.C. §119(e) to U.S. Provisional Patent Application No. 62/291,137, filed on Feb. 4, 2016, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. Consequently, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes a plastic core, upper and lower receptacle terminals held on the plastic core, and an outer iron shell covering the plastic core. Normally, the plastic core of a conventional USB type-C electrical receptacle connector is an assembly of several plastic components, and the upper receptacle terminals and the lower receptacle terminals are respectively assembled with the plastic components.

However, the conventional USB type-C electrical receptacle connector is lack of waterproof functions; water moist may enter the connector from the insertion opening of the outer shell and further enter into an electronic device or a circuit board connected to the connector, so that the terminals, the contacts of the circuit board, and the components of the circuit board may be adversely influenced by the water moist and get short circuited. Therefore, how to solve the aforementioned problem is an issue.

SUMMARY OF THE INVENTION

In view of this, an embodiment of the instant disclosure provides an electrical receptacle connector. The electrical receptacle connector comprises a terminal module, an inner shell, an outer frame, and an outer shell. The terminal module comprises a base portion, a tongue portion outward extended from one of two sides of the base portion, and a plurality of receptacle terminals. The receptacle terminals are held on the base portion. One of two ends of each of the receptacle terminals is extended toward the tongue portion, and the other end of each of the receptacle terminals is protruded out of the base portion. The inner shell encloses the base portion and surrounds an outer periphery of the tongue portion. A front portion of the tongue portion is extended out of the inner shell. The outer frame encloses the inner shell. The outer frame comprises a first inner wall surrounding an outer periphery of the inner shell and a second inner wall forward extended from the first inner wall and surrounding the front portion of the tongue portion. The outer shell is formed on the first inner wall. An inner surface of the outer shell is in contact with an outer surface of the inner shell.

In one embodiment, a plurality of contacts is formed on an outer surface of the outer shell for soldering with the outer surface of the inner shell, and the outer frame comprises a plurality of grooves for soldering with the contacts.

In one embodiment, the first inner wall and the second wall are at different horizontal planes, and the second inner wall and the inner surface of the inner shell are at a same horizontal plane.

In one embodiment, the inner shell comprises a front tubular portion surrounding the outer periphery of the tongue portion and a rear tubular portion enclosing the base portion.

In one embodiment, the front tubular portion comprises a plurality of contact protrusions on an inner surface thereof.

In one embodiment, a plurality of bending sheets is extended from the rear tubular portion to abut against the other side of the base portion.

In one embodiment, a plurality of protruded blocks is formed on two sides of the rear tubular portion to abut against the outer frame.

In one embodiment, a plurality of bending sheets is formed on two sides of a rear portion of the outer shell and the bending sheets are bent to abut against the other side of the base portion.

In one embodiment, the electrical receptacle connector further comprises a waterproof gasket fitted over an insertion opening of the outer frame.

In one embodiment, the electrical receptacle connector further comprises a grounding sheet in the base portion and the tongue portion. In addition, the electrical receptacle connector further comprises a plurality of grounding sheets respectively on the base portion and the tongue portion, one of the grounding sheets is between one of the first ground terminals and one of the second ground terminals, and another one of the grounding sheets is between another one of the first ground terminals and another one of the second ground terminals.

Based on the above, the terminal module is assembled with the inner shell and the outer frame, the outer shell is formed on the outer frame, and the outer shell is in contact with the inner shell. The connector is provided with the outer frame so as to prevent water moist entering into the other end of the outer frame from one end of the outer frame having the insertion opening. In addition, the outer shell is formed on the outer frame to improve the structural strength of the connector. Moreover, the outer shell and the inner shell are soldered with each other through the grooves of the outer frame. Further, the bending sheets are extended from the rear portion of the inner shell to abut against the base portion and prevent the base portion from detaching off the outer frame. Additionally, the bending sheets may be formed on two sides of the rear portion of the outer shell and prevent the base portion from detaching off the outer frame.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
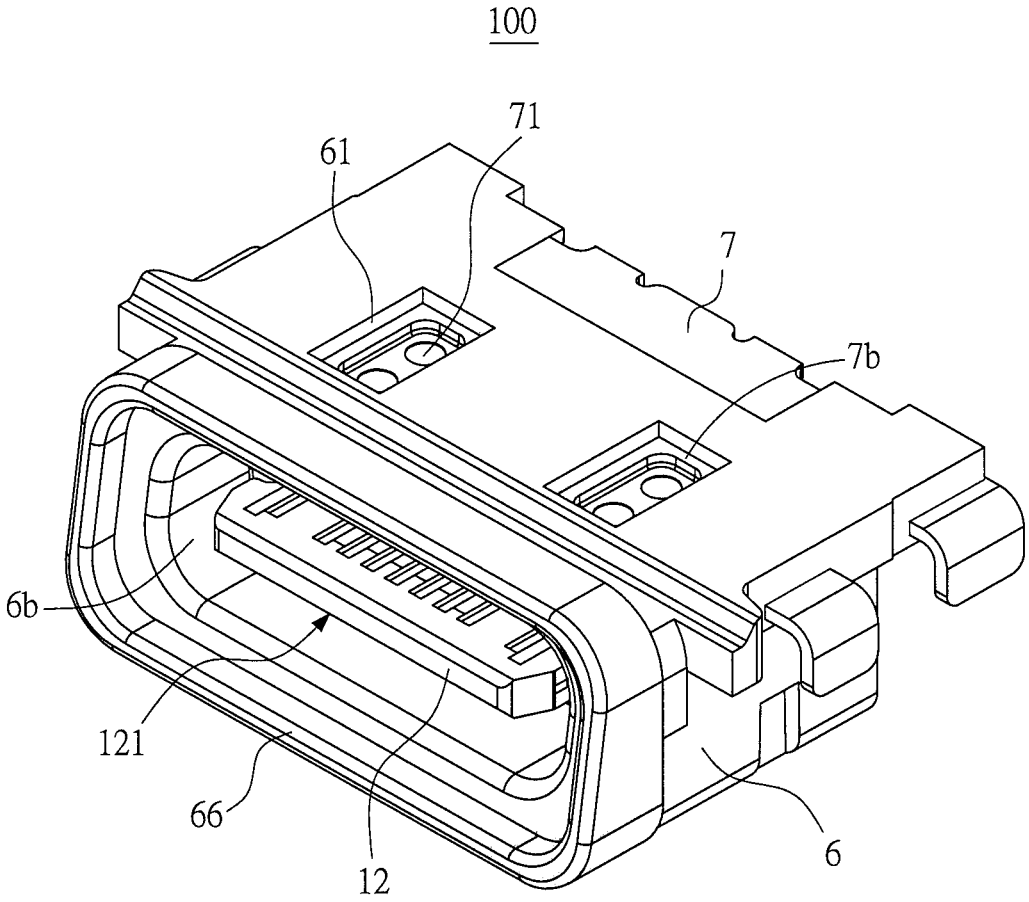
FIG. 1 illustrates a perspective view of an electrical receptacle connector according to a first embodiment of the instant disclosure.
Figure 2:
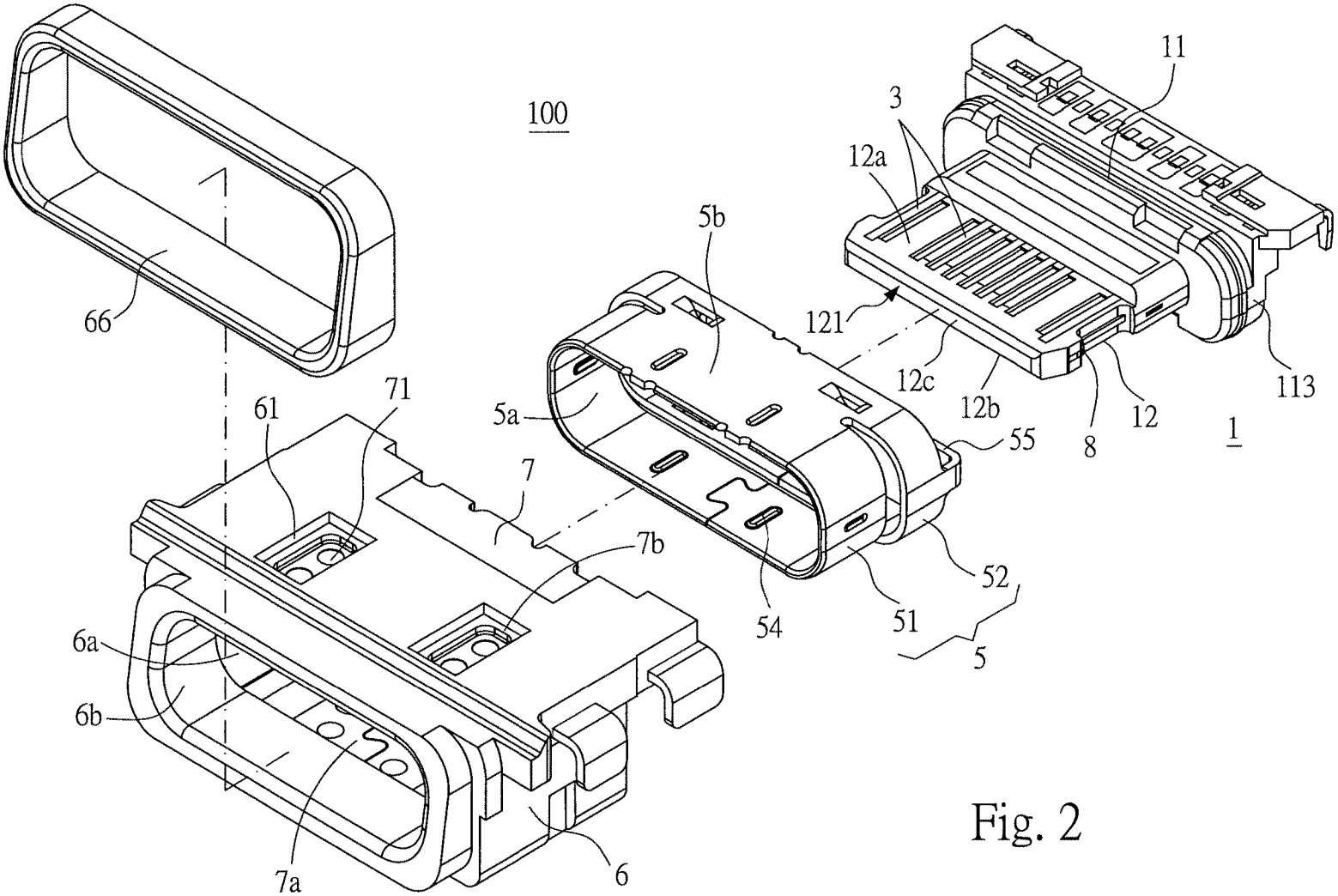
FIG. 2 illustrates a partial exploded view of the electrical receptacle connector of the first embodiment.
Figure 3:
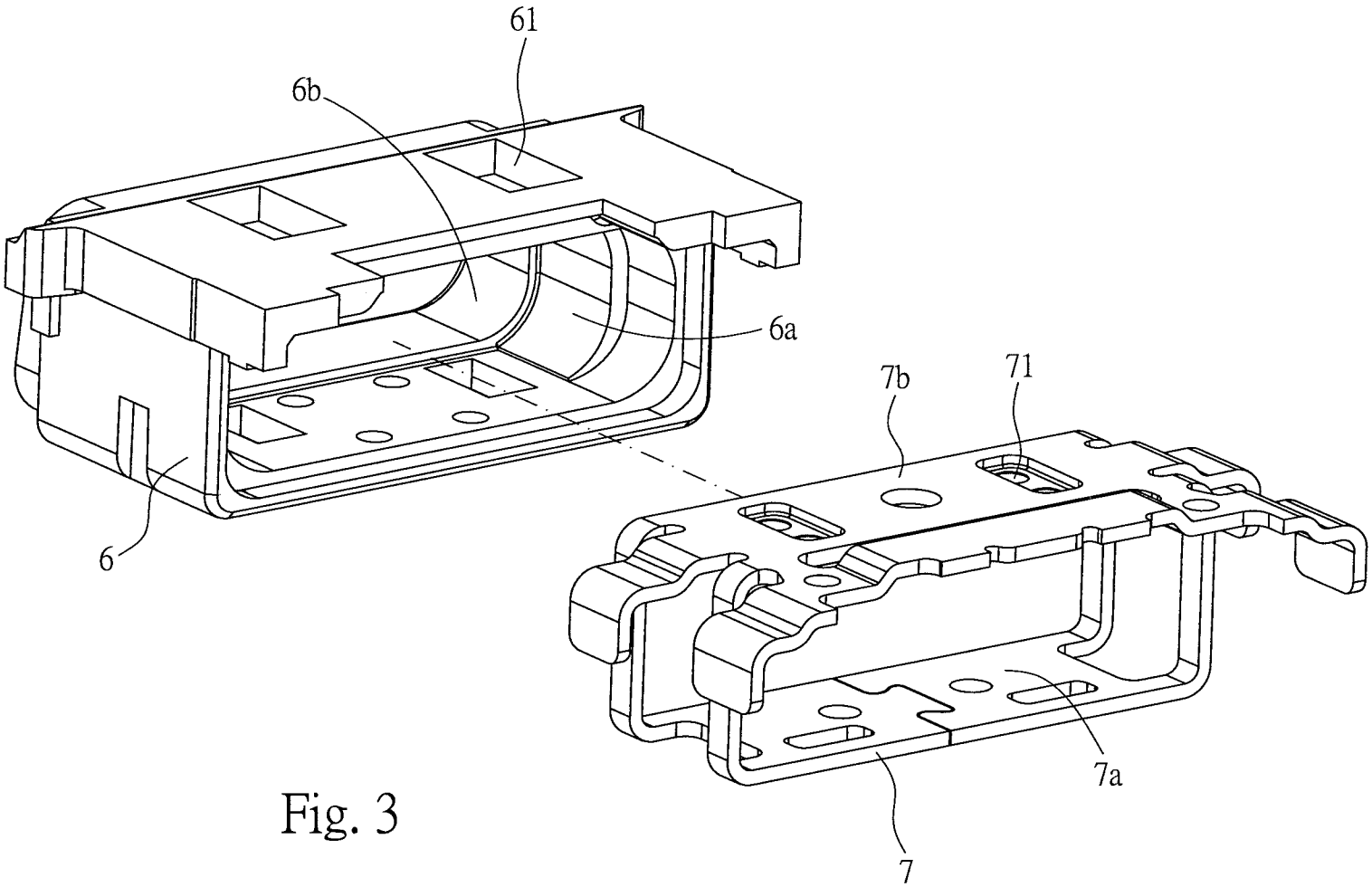
FIG. 3 illustrates an exploded view of an outer frame and an outer shell of the electrical receptacle connector of the first embodiment.
Figure 4:
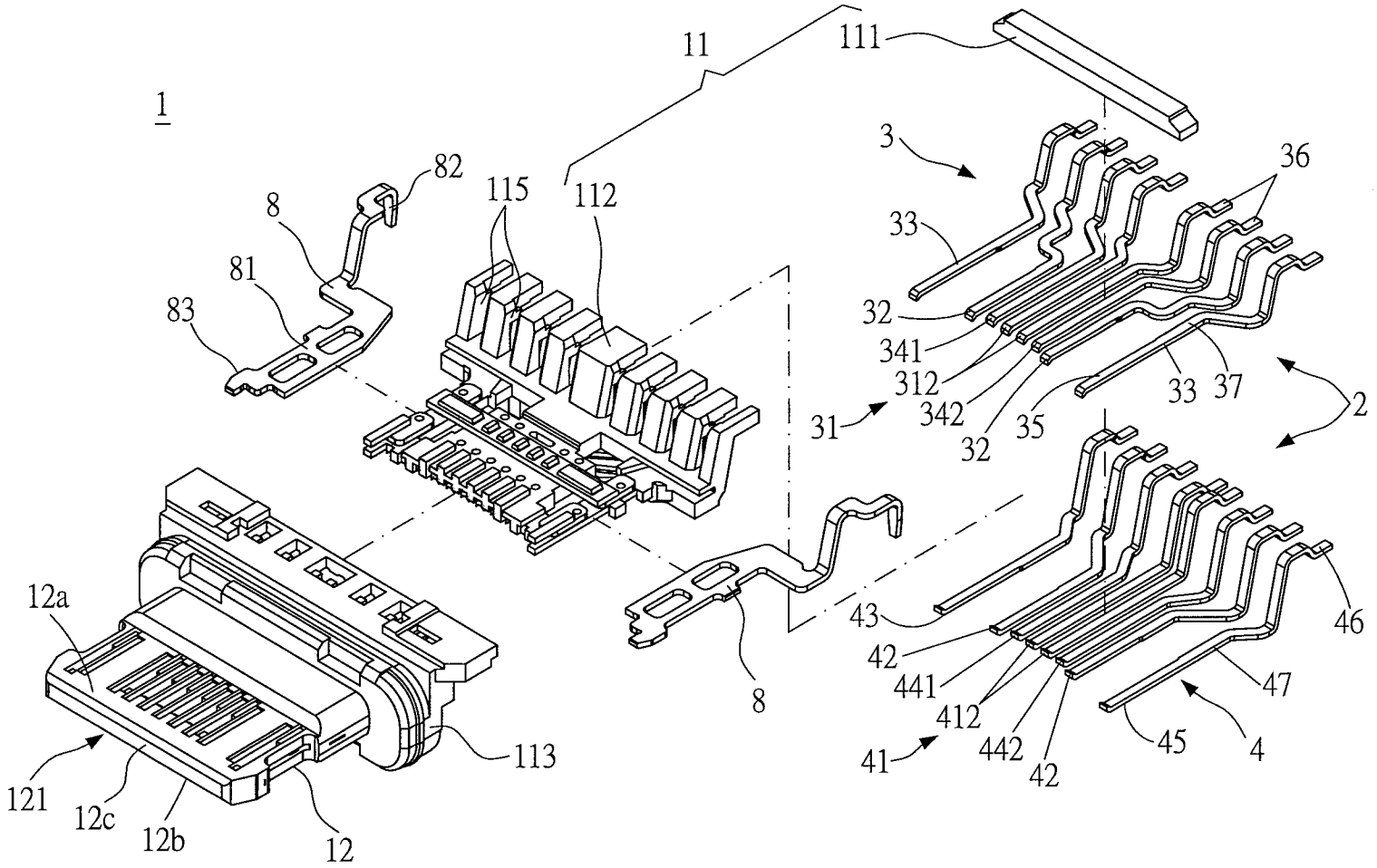
FIG. 4 illustrates an exploded view of a terminal module of the electrical receptacle connector of the first embodiment.

Please refer to FIGS. 1 to 4, illustrating an electrical receptacle connector 100 of a first embodiment of the instant disclosure. FIG. 1 illustrates a perspective view of an electrical receptacle connector according to a first embodiment of the instant disclosure. FIG. 2 illustrates a partial exploded view of the electrical receptacle connector of the first embodiment. FIG. 3 illustrates an exploded view of an outer frame and an outer shell of the electrical receptacle connector of the first embodiment. FIG. 4 illustrates an exploded view of a terminal module of the electrical receptacle connector of the first embodiment. In this embodiment, the electrical receptacle connector 100 comprises a plurality of receptacle terminals, and the number of the receptacle terminals may be adapted for transmitting USB 2.0 signals, but embodiments are not limited thereto. In one embodiment, the number of the receptacle terminals of the electrical receptacle connector 100 may be adapted for transmitting USB 3.0 signals, the electrical receptacle connector 100 can provide a reversible or dual orientation USB Type-C connector interface and pin assignments, i.e., a USB Type-C receptacle connector. In addition, the electrical receptacle connector 10 may comprise grounding sheets 8. In this embodiment, the electrical receptacle connector 100 comprises a terminal module 1, an inner metallic shell 5, an outer insulation frame 6, and an outer metallic shell 7.

Please refer to FIG. 4. In this embodiment, the terminal module 1 comprises a base portion 11, a tongue portion 12, and a plurality of receptacle terminals 2. The tongue portion 12 is extended from one of two sides of the base portion 11. The receptacle terminals 2 are held on the base portion 11. In this embodiment, one of two ends of each of the receptacle terminals 2 is extended toward a front portion of the tongue portion 12, and the other end of each of the receptacle terminals 2 is protruded out of the base portion 11. The receptacle terminals 2 are upper and lower terminals in two rows. In addition, the tongue portion 12 has two opposite surfaces, one is a first surface 12*a*, and the other is the second surface 12*b*. In addition, a front lateral surface 12*c* of the tongue portion 211 is repectively connected the first surface 12*a* and the second surface 12*b*.

Figure 6:
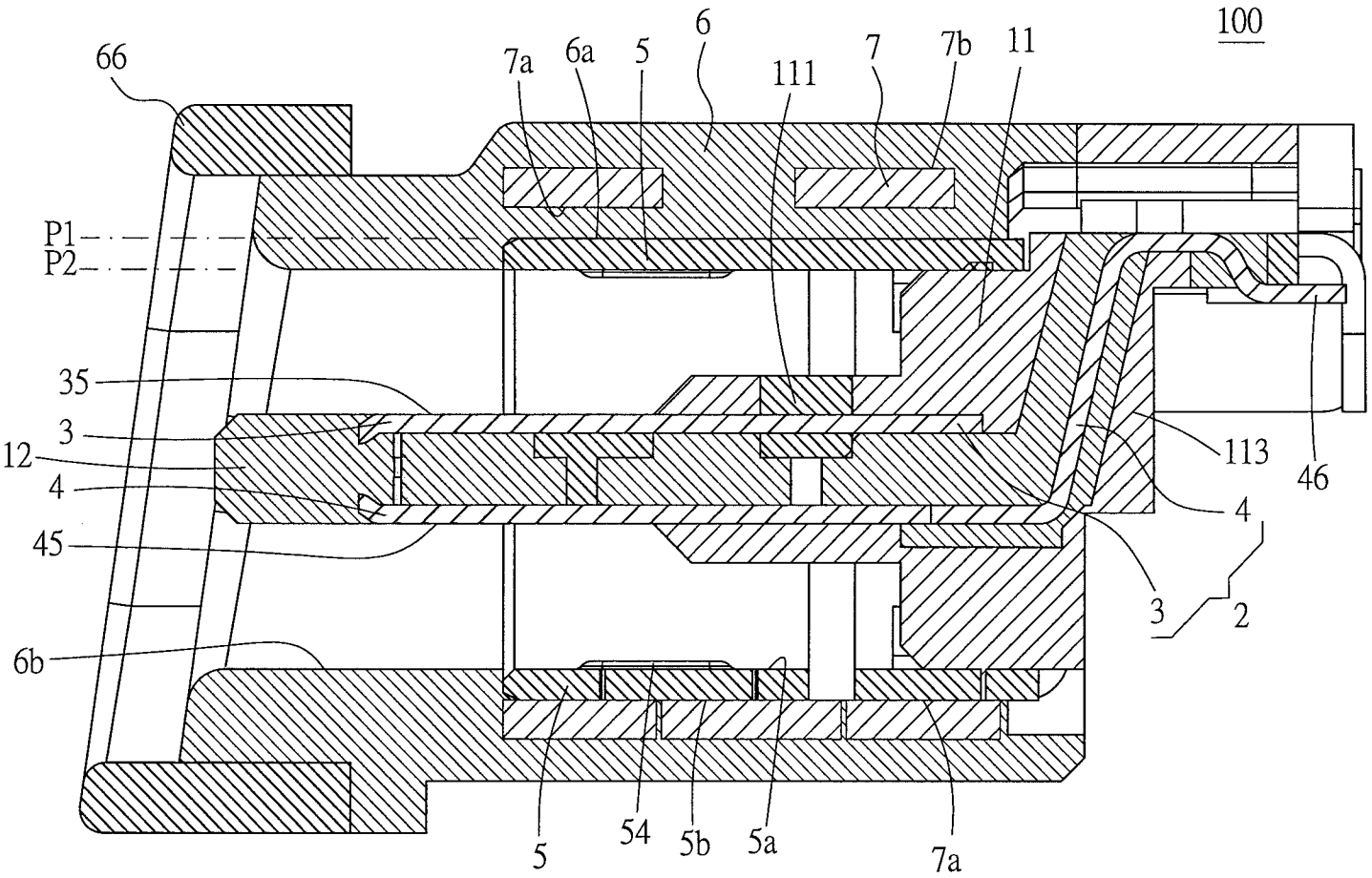
FIG. 6 illustrates a lateral sectional view of the electrical receptacle connector of the first embodiment.

Please refer to FIGS. 2 and 6. FIG. 6 illustrates a lateral sectional view of the electrical receptacle connector of the first embodiment. In this embodiment, the inner metallic shell 5 is a circular sleeve structure enclosing one side of the base portion 11. The inner metallic shell 5 surrounds an outer periphery of a rear portion of the tongue portion 12, and the front portion of the tongue portion 12 is protruded out of the inner metallic shell 5. In other words, the inner metallic shell 5 encloses about half of the tongue portion 12.

Please refer to FIGS. 2 and 6. In this embodiment, the inner metallic shell 5 comprises a front tubular portion 51 surrounding an outer periphery of the tongue portion 12 and a rear tubular portion 52 enclosing the base portion 11. In addition, the front tubular portion 51 comprises a plurality of contact protrusions 54 on an inner surface 5*a* thereof. The contact protrusions 54 are adapted to be in contact with an electrical plug connector. The contact protrusions 54 are inwardly protruded from the inner metallic shell 5 by applying a pressing procedure to the inner metallic shell 5. The contact protrusions 54 do not have cracks so as to prevent water moist from entering into the inner metallic shell 5. The contact protrusion 54 may be of an elongate rib shape or may be a V sheet structure (as shown in FIG. 7).

Please refer to FIGS. 2 and 6. In this embodiment, a plurality of bending sheets 55 is extended from the rear tubular portion 52 to abut against the other side of the base portion 11. Accordingly, the base portion 11 can be positioned by the bending sheets 55, and the bending sheets 55 can prevent the base portion 11 from detaching off the outer insulation frame 6 through the rear portion of the outer insulation frame 6. In addition, in one embodiment, a plurality of bending sheets 75 is formed on two sides of a rear portion of the outer metallic shell 7. The bending sheets 75 are bent to abut against the rear portion of the base portion 11, and the bending sheets 75 can prevent the base portion 11 from detaching off the outer insulation frame 6 through the rear portion of the outer insulation frame 6 (as shown in FIG. 7).

Figure 7:
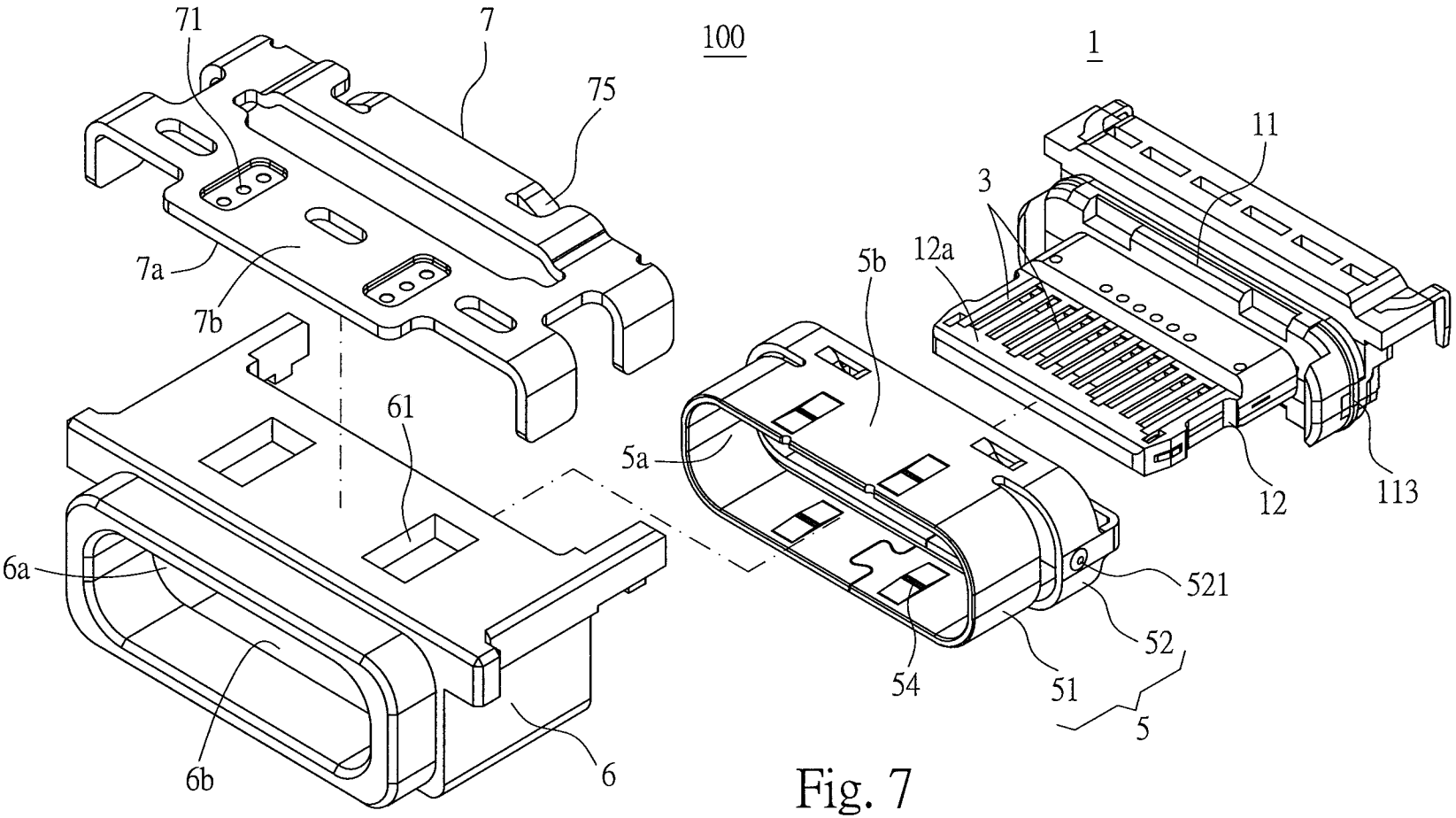
FIG. 7 illustrates a partial exploded view of an electrical receptacle connector according to a second embodiment of the instant disclosure.

In addition, in one embodiment, a plurality of protruded blocks 521 is formed on two sides of the rear tubular portion 52 to abut against the outer insulation frame 6 (as shown in FIG. 7). After the outer metallic shell 7 is formed on the outer insulation frame 6, the protruded blocks 521 are mated with and in contact with the outer insulation frame 6 to prevent the outer insulation frame 6 from being freely moved relative to the inner metallic shell 5.

Figure 5:
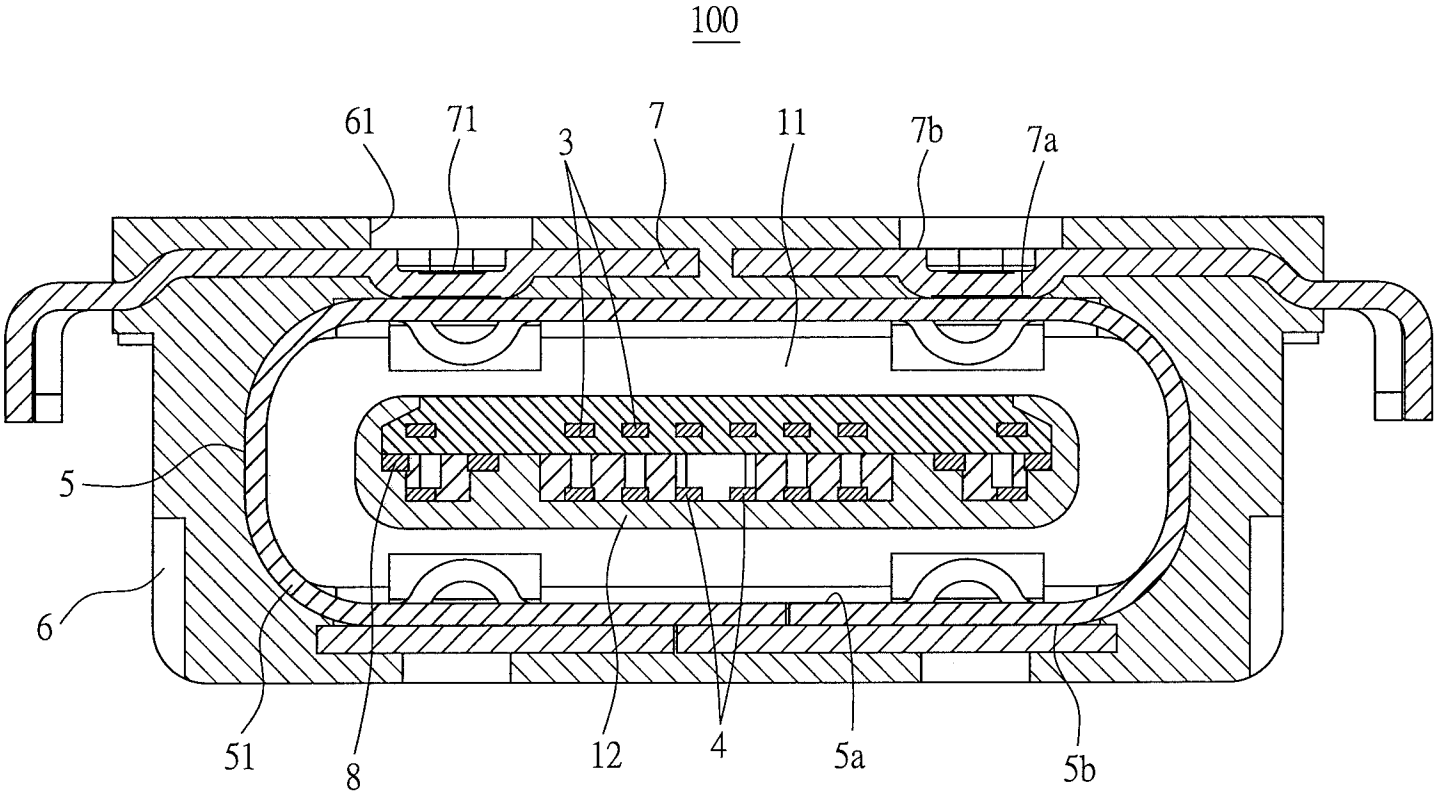
FIG. 5 illustrates a front sectional view of the electrical receptacle connector of the first embodiment.

Please refer to FIGS. 2, 3, 5, and 6. FIG. 5 illustrates a front sectional view of the electrical receptacle connector of the first embodiment. In this embodiment, the outer insulation frame 6 is made of plastic materials, and the outer insulation frame 6 is a hollowed rectangular frame. In this embodiment, the outer insulation frame 6 encloses the inner metallic shell 5. Glue dispensing procedures are applied between the outer insulation frame 6 and the rear portion of the base portion 11 and between the inner metallic shell 5 and the rear portion of the base portion 11. Therefore, a connection between the outer insulation frame 6 and the base portion 11 and the connection between the inner metallic shell 5 and the base portion 11 can be properly sealed to provide a waterproof function for the connector. Furthermore, the outer insulation frame 6 comprises a second inner wall 6*b* surrounding the outer periphery of the inner metallic shell 5 and a first inner wall 6*a* forward extended from the second inner wall 6*b* and surrounding the outer periphery of a front portion 121 of the tongue portion 12. The second inner wall 6*b* is a portion of the inner surface of the outer insulation frame 6 which is near to an insertion opening of the outer insulation frame 6, and the first inner wall 6*a* is a portion of the inner surface of the outer insulation frame 6 near to the first inner wall 6*a* of the outer insulation frame 6. In addition, the first inner wall 6*a* and the second inner wall 6*b* are at different horizontal planes P1/P2. The first inner wall 6*a* is located at a first horizontal plane P1, and the second inner wall 6*b* is located at a second horizontal plane P2. In other words, an inner dimension of the first inner wall 6*a* is greater than an inner dimension of the second inner wall 6*b*. The second inner wall 6*b* and an inner surface 5*a* of the inner metallic shell 5 are located at a same horizontal plane (i.e., the second horizontal plane P2).

Please refer to FIGS. 1, 2, and 6. The electrical receptacle connector 100 further comprises a waterproof gasket 66 fitted over an insertion opening of the outer insulation frame 6. When the electrical receptacle connector 100 is assembled to a housing of an electronic device through a connection hole, the waterproof gasket 66 is firmly attached on the periphery of the connection hole to prevent water moist from entering into the housing or the connector through the connection hole.

Please refer to FIGS. 2 and 3. The outer metallic shell 7 is a metallic shell, and the outer metallic shell 7 is a hollowed rectangular frame, but embodiments are not limited thereto. In some embodiments, the outer metallic shell 7 may be approximately formed as a U-shape structure (as shown in FIG. 7). In this embodiment, the outer metallic shell 7 is formed on the first inner wall 6*a* by insert-molding techniques and integrally formed with the outer insulation frame 6. In addition, the inner surface 7*a* of the outer metallic shell 7 is in contact with the outer surface 5*b* of the inner metallic shell 5 (as shown in FIG. 5). In this embodiment, a plurality of contacts 71 is formed on an outer surface 7*b* of the outer metallic shell 7 for soldering with the outer surface 5*b* of the inner metallic shell 5. Moreover, the outer insulation frame 6 comprises a plurality of grooves 61 for soldering with the contacts 71.

Please refer to FIGS. 2 and 4. In this embodiment, the tongue portion 12 and the base portion 11 are integrally formed as a whole, and the tongue portion 12 is formed on one side of the base portion 11. In other words, the base portion 11 and the tongue portion 12 are formed by combining a first terminal base 111, a second terminal base 112, and a third terminal base 113. Furthermore, first receptacle terminals 3 are held on the first terminal base 111, and second receptacle terminals 4 are held on the second terminal base 112. After the first terminal base 111 is combined with the second terminal base 112, the third terminal base 113 is provided to enclose the assembly of the first terminal base 111 and the second terminal base 112. It is understood that the structure of the base portion 11 is not limited to the above-mentioned structure. In some embodiments, the first terminal base 111, the second terminal base 112, and the third terminal base 113 are integrated as a unitary piece (or two pieces).

Please refer to FIGS. 4 and 6. In this embodiment, the second terminal base 112 comprises a plurality of fixing grooves 115 for positioning tail portions 36 of the first receptacle terminals 3, and tail portions 46 of the second receptacle terminals 4 are formed in the second terminal base 112, and the tail portions 36 are separated from the tail portions 46 by the second terminal base 112 between the fixing grooves 115.

Please refer to FIGS. 2, 4, 5, and 6. In this embodiment, the receptacle terminals 2 comprise the first receptacle terminals 3 and the second receptacle terminals 4 respectively as upper and lower terminals, so that the receptacle terminals 2 form two rows, but embodiments are not limited thereto. In one embodiment, the receptacle terminals 2 may be single rowed, only comprise the first receptacle terminals 3 (or the second receptacle terminals 4), and exclude the second receptacle terminals 4 (or the first receptacle terminals 3).

Please refer to FIGS. 2, 4, 5, and 6. In this embodiment, the first receptacle terminals 3 are held on the first terminal base 111. Each of the first receptacle terminals 3 comprises a flat contact portion 35 and the tail portion 36 at two ends thereof. That is, the tail portion 36 is extended from one end of the flat contact portion 35. Terminal grooves on one of the two opposite surfaces of the tongue portion 12 are positioned with the flat contact portions 35, and the tail portions 36 are protruded out of the base portion 11.

Please refer to FIGS. 2, 4, 5, and 6. In this embodiment, the second receptacle terminals 4 and the grounding sheets 8 are held on the second terminal base 112. Each of the second receptacle terminals 4 comprises a flat contact portion 45 and the tail portion 46 at two ends thereof. That is, the tail portion 46 is extended from one end of the flat contact portion 45. The tail portions 46 are protruded out of the base portion 11.

Please refer to FIGS. 2, 4, 5, and 6. The first receptacle terminals 3 comprise a plurality of first signal terminals 31, a plurality of power terminals 32, and a plurality of ground terminals 33. The first signal terminals 31 comprise a pair of first low-speed signal terminals 312. In other words, the first receptacle terminals 3 comprise a pair of ground terminals 33 (Gnd), a pair of power terminals 32 (Power/VBUS), a first function detection terminal 341 (CC1 or CC2, a terminal for inserting orientation detection of the connector and for cable recognition), a pair of first low-speed signal terminals 312 (D+−, differential signal terminals for low-speed signal transmission), and a first supplement terminal 342 (SBU1 or SBU2, a terminal reserved for other purposes). In this embodiment, eight first receptacle terminals 3 are provided for transmitting USB 2.0 signals.

Furthermore, in some embodiments, the first receptacle terminals 3 may comprise twelve terminals for transmitting USB 3.0 signals. From a front view of the first receptacle terminals 3, the first receptacle terminals 3 comprise, from left to right, a ground terminal 33 (Gnd), a first pair of first high-speed signal terminals (TX1+−, differential signal terminals for high-speed signal transmission), a power terminal 32 (Power/VBUS), a first function detection terminal 341 (CC1), a pair of first low-speed signal terminals 312 (D+−), a first supplement terminal 342 (SBU1), a power terminal 32 (Power/VBUS), a second pair of first high-speed signal terminals (RX2+−, differential signal terminals for high-speed signal transmission), and a ground terminal 33 (Gnd).

In this embodiment, each pair of the first high-speed signal terminals is between the corresponding power terminal 32 and the adjacent ground terminal 33. The pair of the first low-speed signal terminals 312 is between the first function detection terminal 341 and the first supplement terminal 342.

In some embodiments, in accordance with transmitting USB 3.0 signals, twelve first receptacle terminals 3 are provided. Nevertheless, the rightmost ground terminal 33 (Gnd) (or the leftmost ground terminal 33 (Gnd)) or the first supplement terminal 342 (SBU1) can be further omitted. Therefore, the total number of the first receptacle terminals 3 can be reduced from twelve terminals to seven terminals.

Furthermore, the ground terminal 33 (Gnd) may be replaced by a power terminal 32 (Power/VBUS) and provided for power transmission. In this embodiment, the width of the power terminal 32 (Power/VBUS) may be, but not limited to, equal to the width of the first signal terminal 31. In some embodiments, the width of the power terminal 32 (Power/VBUS) may be greater than the width of the first signal terminal 31 and an electrical receptacle connector 100 having the power terminal 32 (Power/VBUS) can be provided for large current transmission.

Please refer to FIGS. 2, 4, 5, and 6. In this embodiment, the first receptacle terminals 3 are held on the first terminal base 111 and formed as the upper-row terminals of the electrical receptacle connector 100. In this embodiment, each of the first receptacle terminals 3 comprises a flat contact portion 35, a body portion 37, and a tail portion 36. For each of the first receptacle terminals 3, the body portion 37 is held in the first terminal base 111, the flat contact portion 35 is extended forward from the body portion 37 in the rear-to-front direction and partly exposed upon the first surface 12*a* of the tongue portion 12, and the tail portion 36 is extended backward from the body portion 37 in the front-to-rear direction and protruded from the rear of the first terminal base 111. The first signal terminals 31 are disposed on the first surface 12*a* of the tongue portion 12 and transmit first signals (namely, USB 2.0 signals). Moreover, the tail portions 36 may be bent horizontally to form flat legs, named legs manufactured by SMT (surface mounted technology), which can be mounted or soldered on the surface of a printed circuit board by using surface mount technology. Alternatively, the tail portions 36 may be extended downwardly to form vertical legs, named legs manufactured by through-hole technology, which can be inserted into holes drilled in a printed circuit board (PCB).

Please refer to FIGS. 2, 4, 5, and 6. The second receptacle terminals 4 comprise a plurality of second signal terminals 41, a plurality of power terminals 42, and a plurality of ground terminals 43. The second signal terminals 41 comprise a pair of second low-speed signal terminals 412. In other words, the second receptacle terminals 4 comprise a pair of ground terminals 43 (Gnd), a pair of power terminals 42 (Power/VBUS), a second function detection terminal 441 (CC1 or CC2, a terminal for inserting orientation detection of the connector and for cable recognition), a pair of second low-speed signal terminals 412 (D+−, differential signal terminals for low-speed signal transmission), and a second supplement terminal 442 (SBU1 or SBU2, a terminal reserved for other purposes). In this embodiment, eight second receptacle terminals 4 are provided for transmitting USB 2.0 signals.

Furthermore, in some embodiments, the second receptacle terminals 4 may comprise twelve terminals for transmitting USB 3.0 signals. From a front view of the second receptacle terminals 4, the second receptacle terminals 4 comprise, from right to left, a ground terminal 43 (Gnd), a first pair of second high-speed signal terminals (TX2+−, differential signal terminals for high-speed signal transmission), a power terminal 42 (Power/VBUS), a second function detection terminal 441 (CC2), a pair of second low-speed signal terminals 412 (D+−), a second supplement terminal 442 (SBU2), a power terminal 42 (Power/VBUS), a second pair of second high-speed signal terminals (RX1+−, differential signal terminals for high-speed signal transmission), and a ground terminal 43 (Gnd).

In this embodiment, each pair of the second high-speed signal terminals is between the corresponding power terminal 42 and the adjacent ground terminal 43. The pair of the second low-speed signal terminals 412 is between the second function detection terminal 441 and the second supplement terminal 442.

In some embodiments, in accordance with transmitting USB 3.0 signals, twelve second receptacle terminals 4 are provided. Nevertheless, the rightmost ground terminal 43 (Gnd) (or the leftmost ground terminal 43 (Gnd)) or the second supplement terminal 442 (SBU2) can be further omitted. Therefore, the total number of the second receptacle terminals 4 can be reduced from twelve terminals to seven terminals.

Furthermore, the ground terminal 43 (Gnd) may be replaced by a power terminal 42 (Power/VBUS) and provided for power transmission. In this embodiment, the width of the power terminal 42 (Power/VBUS) may be, but not limited to, equal to the width of the second signal terminal 41. In some embodiments, the width of the power terminal 42 (Power/VBUS) may be greater than the width of the second signal terminal 41 and an electrical receptacle connector 100 having the power terminal 42 (Power/VBUS) can be provided for large current transmission.

Please refer to FIGS. 2, 4, 5, and 6. In this embodiment, the second receptacle terminals 4 are held on the second terminal base 112 and formed as the lower-row terminals of the electrical receptacle connector 100. In addition, the first receptacle terminals 3 are substantially parallel with the second receptacle terminals 4. In this embodiment, each of the second receptacle terminals 4 comprises a flat contact portion 45, a body portion 47, and a tail portion 46. For each of the second receptacle terminals 4, the body portion 47 is held in the second terminal base 112, the flat contact portion 45 is extended forward from the body portion 47 in the rear-to-front direction and partly exposed upon the second surface 12*b* of the tongue portion 12, and the tail portion 46 is extended backward from the body portion 47 in the front-to-rear direction and protruded from the rear of the second terminal base 112. The second signal terminals 31 are disposed on the second surface 12*b* of the tongue portion 12 and transmit first signals (namely, USB 2.0 signals). Moreover, the tail portions 46 may be bent horizontally to form flat legs, named legs manufactured by SMT (surface mounted technology), which can be mounted or soldered on the surface of a printed circuit board by using surface mount technology. Alternatively, the tail portions 36 may be extended downwardly to form vertical legs, named legs manufactured by through-hole technology, which can be inserted into holes drilled in a printed circuit board (PCB). The tail portions 36, 46 are aligned into a same row and separated with each other. From a top view of the tail portions 36, 46, the arrangement order of the tail portions 36, 46 (for the sake of convenience, herein called first tail portion 36 and second tail portion 46, respectively), may be a first tail portion 36, a second tail portion 46, a first tail portion 36, a second tail portion 46, and so forth; alternatively, the arrangement order of the tail portions 36, 46 may be a first tail portion 36, a second tail portion 46, a second tail portion 46, a first tail portion 36, and so forth.

Please refer to FIGS. 2, 4, 5, and 6. In this embodiment, the first receptacle terminals 3 and the second receptacle terminals 4 are disposed upon the first surface 12*a* and the second surface 12*b* of the tongue portion 12, respectively, and pin-assignments of the first receptacle terminals 3 and the second receptacle terminals 4 are point-symmetrical with a central point of a receptacle cavity of the outer insulation frame 6 as the symmetrical center. In other words, pin-assignments of the first receptacle terminals 3 and the second receptacle terminals 4 have 180-degree symmetrical design with respect to the central point of the receptacle cavity of the outer insulation frame 6 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 3 (or the second receptacle terminals 4), are rotated by 180 degrees with the symmetrical center as the rotating center, the first receptacle terminals 3 and the second receptacle terminals 4 are overlapped. That is, the rotated first receptacle terminals 3 are arranged at the position of the original second receptacle terminals 4, and the rotated second receptacle terminals 4 are arranged at the position of the original first receptacle terminals 3. In other words, the first receptacle terminals 3 and the second receptacle terminals 4 are arranged upside down, and the pin assignments of the flat contact portions 35 are left-right reversal with respect to that of the flat contact portions 45. An electrical plug connector is inserted into the electrical receptacle connector 100 with a first orientation where the first surface 12*a* is facing up, for transmitting first signals. Conversely, the electrical plug connector is inserted into the electrical receptacle connector 100 with a second orientation where the first surface 12*a* is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Additionally, in some embodiments, the electrical receptacle connector 100 is devoid of the first receptacle terminals 3 (or the second receptacle terminals 4) when an electrical plug connector to be mated with the electrical receptacle connector 100 has upper and lower plug terminals. In the case that the first receptacle terminals 3 are omitted, the upper plug terminals or the lower plug terminals of the electrical plug connector are in contact with the second receptacle terminals 4 of the electrical receptacle connector 100 when the electrical plug connector is inserted into the electrical receptacle connector 100 with the dual orientations. Conversely, in the case that the second receptacle terminals 4 are omitted, the upper plug terminals or the lower plug terminals of the electrical plug connector are in contact with the first receptacle terminals 3 of the electrical receptacle connector 100 when the electrical plug connector is inserted into the electrical receptacle connector 100 with the dual orientations.

Please refer to FIGS. 2, 4, 5, and 6. In this embodiment, as viewed from the front of the receptacle terminals 3, 4, the position of the first receptacle terminals 3 corresponds to the position of the second receptacle terminals 4. In other words, the positions of the flat contact portions 35 are respectively aligned with the positions of the flat contact portions 45, but embodiments are not limited thereto. In some embodiments, the first receptacle terminals 3 may be aligned by an offset with respect to the second receptacle terminals 4. That is, the flat contact portions 35 are aligned by an offset with respect to the flat contact portions 45. Accordingly, because of the offset alignment of the flat contact portions 35, 45, the crosstalk between the first receptacle terminals 3 and the second receptacle terminals 4 can be reduced during signal transmission. It is understood that, when the receptacle terminals 3, 4 of the electrical receptacle connector 100 have the offset alignment, plug terminals of an electrical plug connector to be mated with the electrical receptacle connector 100 would also have the offset alignment. Hence, the plug terminals of the electrical plug connector can be in contact with the receptacle terminals 3, 4 of the electrical receptacle connector 100 for power or signal transmission.

Please refer to FIGS. 2, 4, 5, and 6. In this embodiment, the electrical receptacle connector 100 further comprises a plurality of grounding sheets 8 respectively held on the base portion 11 and the tongue portion 12. In addition, one of the grounding sheets 8 is between one of the ground terminals 33 and one of the power terminals 42; specifically, the grounding sheet 8 is between one of the ground terminals 33 and one of the ground terminals 43. Conversely, another one of the grounding sheets 8 is between one of the ground terminals 43 and one of the power terminals 32; specifically, the grounding sheet 8 is between another one of the grounding terminals 33 and another one of the grounding terminals 43. In other words, no grounding sheet 8 is between the first signal terminals 31 and the second signal terminals 41, because the terminals for low-speed signal transmission do not require the grounding sheet 8 for shielding. In the case that a grounding sheet 8 is provided between the first signal terminals 31 and the second signal terminals 41, the tongue portion 12 would be worn by the repeated plug-and-pull operation to make the first signal terminals 31 or the second signal terminals 41 be easily in contact with the grounding sheet 8. As a result, short circuit issues may occur. On the other hand, in this embodiment, the two grounding sheets are respectively between the ground terminals and the power terminals. Accordingly, because the signal terminals 31, 41 are not in contact with the grounding sheet 8 when the tongue portion 12 is worn, the short circuit issues can be avoided.

Figure 8:
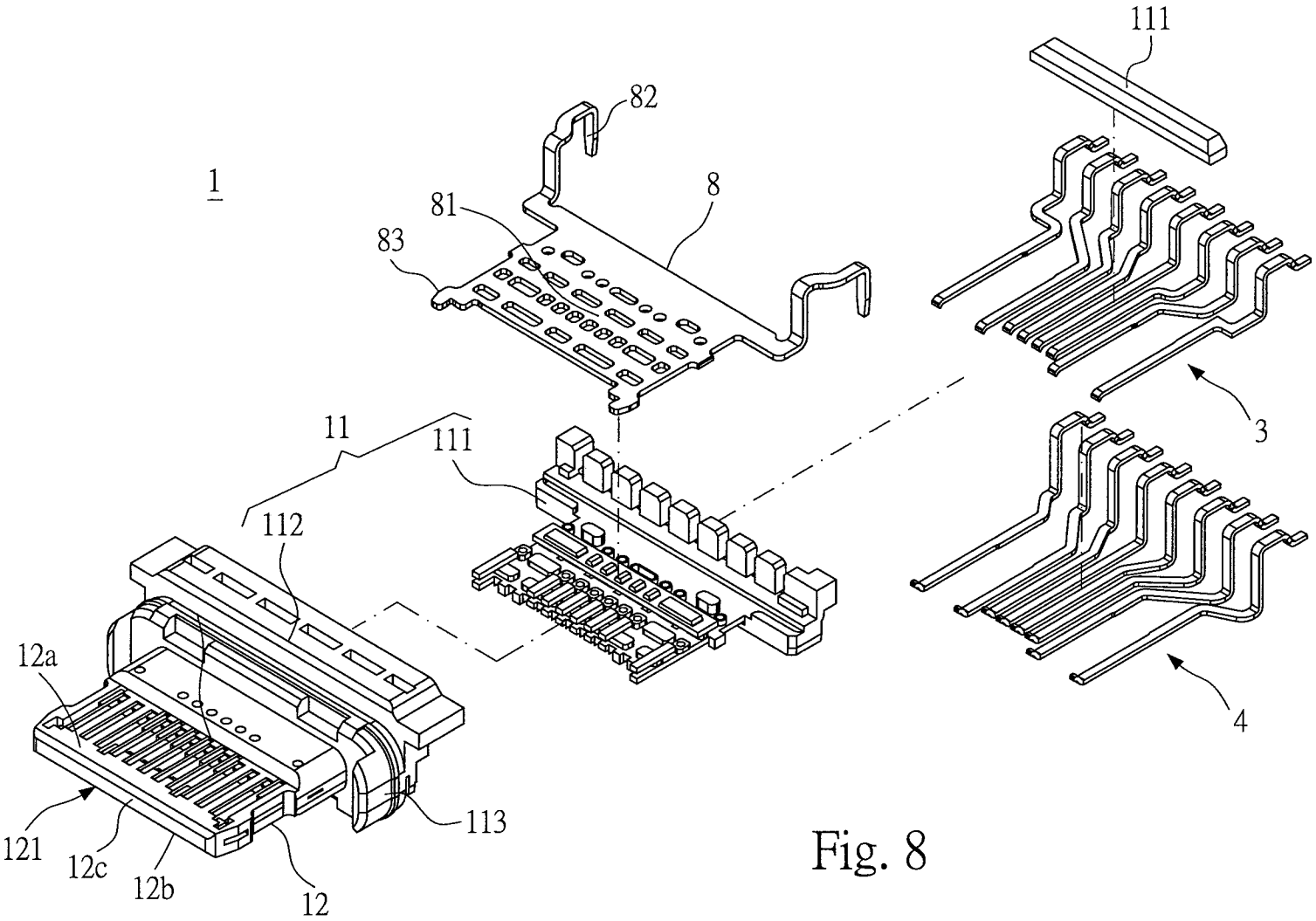
FIG. 8 illustrates an exploded view of an outer frame and an outer shell of the electrical receptacle connector of the second embodiment.

Please refer to FIGS. 7 and 8, illustrating an electrical receptacle connector 100 according to a second embodiment of the instant disclosure. In this embodiment, the electrical receptacle connector 100 may comprise a single grounding sheet 8 in the base portion 11 and the tongue portion 12. The grounding sheet 8 comprises a sheet body 81 and a plurality of legs 82. The sheet body 81 is between the flat contact portions 35 of the first receptacle terminals 3 and the flat contact portions 45 of the second receptacle terminals 4. Specifically, the sheet body 81 may be lengthened and widened, so that the front of the sheet body 81 is near to the front lateral surface 12*c* of the tongue portion 12. Two sides of the sheet body 81 are protruded from two sides of the tongue portion 12 for being in contact with an electrical plug connector. Moreover, the rear of the sheet body 81 is near to the rear of the second terminal base 112. Accordingly, the sheet body 81 can be disposed on the tongue portion 12 and the second terminal base 112, and the structural strength of the tongue portion 12 and the shielding performance of the tongue portion 12 can be improved.

Please refer to FIGS. 7 and 8. The legs 82 are extended from the rear portion of the grounding sheet 8 to form vertical legs (legs manufactured by through hole technology). That is, the legs 82 are exposed from the second terminal base 112 and in contact with the circuit board. In this embodiment, the crosstalk interference can be reduced by the shielding of the grounding sheet 8 when the flat contact portions 35, 45 transmit signals. Furthermore, the structural strength of the tongue portion 12 can be improved by the assembly of the grounding sheet 8. In addition, the legs 82 of the grounding sheet 8 are exposed from the second terminal base 112 and in contact with the circuit board for conduction and grounding.

Please refer to FIGS. 7 and 8. The grounding sheet 8 further comprises a plurality of hooks 83. The hooks 83 are extended outward from two sides of the front portion of the sheet body 81 and protruded out of the front lateral surface 12*c* and two sides of the tongue portion 12. When an electrical plug connector is mated with the electrical receptacle connector 100, elastic pieces at two sides of an insulated housing of the electrical plug connector are engaged with the hooks 83, and the elastic pieces would not wear against the tongue portion 12 of the electrical receptacle connector 100.

Based on the above, the terminal module is assembled with the inner metallic shell and the outer insulation frame, the outer metallic shell is formed on the outer insulation frame, and the outer metallic shell is in contact with the inner metallic shell. The connector is provided with the outer insulation frame so as to prevent water moist entering into the other end of the outer insulation frame from one end of the outer insulation frame having the insertion opening. In addition, the outer metallic shell is formed on the outer insulation frame to improve the structural strength of the connector. Moreover, the outer metallic shell and the inner metallic shell are soldered with each other through the grooves of the outer insulation frame. Further, the bending sheets are extended from the rear portion of the inner metallic shell to abut against the base portion and prevent the base portion from detaching off the outer insulation frame. Additionally, the bending sheets may be formed on two sides of the rear portion of the outer metallic shell and prevent the base portion from detaching off the outer insulation frame.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a terminal module comprising a base portion, a tongue portion a extended from one of two sides of the base portion, and a plurality of receptacle terminals, wherein the receptacle terminals are held on the base portion, one of two ends of each of the receptacle terminals is extended toward the tongue portion, and the other end of each of the receptacle terminals is protruded out of the base portion;

an inner metallic shell enclosing the base portion and surrounding an outer periphery of the tongue portion, wherein a front portion of the tongue portion is extended out of the inner metallic shell;

an outer insulation frame enclosing the inner metallic shell, wherein the outer insulation frame comprises a first inner wall surrounding an outer periphery of the inner metallic shell and a second inner wall forward extended from the first inner wall and surrounding the front portion of the tongue portion; and an outer metallic shell formed on the first inner wall, wherein an inner surface of the outer metallic shell is in contact with an outer surface of the inner metallic shell.

2. The electrical receptacle connector according to claim 1, wherein a plurality of contacts is formed on an outer surface of the outer metallic shell for soldering with the outer surface of the inner metallic shell, and the outer insulation frame comprises a plurality of grooves for soldering with the contacts.

3. The electrical receptacle connector according to claim 1, wherein the first inner wall and the second wall are at different horizontal planes, and the second inner wall and the inner surface of the inner metallic shell are at a same horizontal plane.

4. The electrical receptacle connector according to claim 1, wherein the inner metallic shell comprises a front tubular portion surrounding the outer periphery of the tongue portion and a rear tubular portion enclosing the base portion.

5. The electrical receptacle connector according to claim 4, wherein the front tubular portion comprises a plurality of contact protrusions on an inner surface thereof.

6. The electrical receptacle connector according to claim 4, wherein a plurality of bending sheets is extended from the rear tubular portion to abut against the other side of the base portion.

7. The electrical receptacle connector according to claim 4, wherein a plurality of protruded blocks is formed on two sides of the rear tubular portion to abut against the outer insulation frame.

8. The electrical receptacle connector according to claim 1, wherein a plurality of bending sheets is formed on two sides of a rear portion of the outer metallic shell and the bending sheets are bent to abut against the other side of the base portion.

9. The electrical receptacle connector according to claim 1, further comprising a waterproof gasket fitted over an insertion opening of the outer insulation frame.

10. The electrical receptacle connector according to claim 1, further comprising a grounding sheet in the base portion and the tongue portion.

11. The electrical receptacle connector according to claim 1, wherein the receptacle terminals comprise a plurality of first receptacle terminals and a plurality of receptacle terminals held on the base portion and the tongue portion, the first receptacle terminals comprises a plurality of first signal terminals, a plurality of first power terminals, and a plurality of first ground terminals, the second receptacle terminals comprise a plurality of second signal terminals, a plurality of second power terminals, and a plurality of second ground terminals.

12. The electrical receptacle connector according to claim 11, further comprising a plurality of grounding sheets respectively on the base portion and the tongue portion, one of the grounding sheets is between one of the first ground terminals and one of the second ground terminals, and another one of the grounding sheets is between another one of the first ground terminals and another one of the second ground terminals.

13. The electrical receptacle connector according to claim 1, wherein the base portion and the tongue portion are formed by combining a first terminal base, a second terminal base, and a third terminal base, the first receptacle terminals are held on the first terminal base, the second receptacle terminals are held on the second terminal base.

14. The electrical receptacle connector according to claim 13, wherein the second terminal base comprises a plurality of fixing grooves for positioning first tail portions of the first receptacle terminals.

* * * * *